United States Patent [19]

Perne et al.

[11] Patent Number: 4,771,905

[45] Date of Patent: Sep. 20, 1988

[54] TIGHT SCREW CAP FOR THREADED CONTAINER NECK

[75] Inventors: Raymond Perne, Anse; Philippe Odet, Chasselay, both of France

[73] Assignee: Astra Plastique (A Société Anonyme - French), Saint-Georges-De-Reneins, France

[21] Appl. No.: 64,292

[22] Filed: Jun. 17, 1987

[30] Foreign Application Priority Data

Jun. 17, 1986 [FR] France ..... 86 09142

[51] Int. Cl.[4] ..... B65D 41/04

[52] U.S. Cl. ..... 215/270; 215/329

[58] Field of Search ..... 215/270, 271, 329, 344, 215/341

[56] References Cited

U.S. PATENT DOCUMENTS 4,574,966 3/1986 Sandhaus ..... 215/270

FOREIGN PATENT DOCUMENTS 2409399 9/1974 Fed. Rep. of Germany ..... 215/329

*Primary Examiner*—Donald F. Norton

*Attorney, Agent, or Firm*—Browdy and Neimark

[57] ABSTRACT

A tight screw cap having a cylindrical outside skirt threaded on the inside surrounding a pan bottom having a circular bottom wall surrounded by a cylindrical lateral wall connecting it to the upper edge of the outside skirt of the cap. The outside diameter of this lateral cylindrical wall corresponds to the inside diameter of the threaded upper end of the neck of the container, the length of the cylindrical wall being less than that of the cylindrical skirt.

The bottom wall of the pan bottom is connected to its lateral cylindrical wall by a part in the shape of a crown of bitruncated section delimiting, at the periphery of the bottom wall, an annular groove of approximately annular section projecting, in relation to the bottom wall, from the same side as the free end of the outside skirt.

8 Claims, 1 Drawing Sheet

TIGHT SCREW CAP FOR THREADED CONTAINER NECK

FIELD OF THE INVENTION

The present invention relates to a tight cap for a threaded container neck and more precisely a cap of the type exhibiting a cylindrical outside skirt threaded on the inside surrounding a pan bottom, i.e. a circular downwardly recessed top wall surrounded by a cylindrical lateral wall connecting it to the upper edge of the outside skirt of the cap, the outside diameter of the lateral cylindrical wall of the pan bottom corresponding to the inside diameter of the threaded upper end of the container neck and its length being less than that of the cylindrical skirt of the cap.

BACKGROUND OF THE INVENTION

This type of cap, which is often used with blown plastic containers such as those of PVC, is itself made of injection molded plastic such as polyethylene, and the most frequently encountered problem is obtaining a good seal despite the relative flexibility of the material making up the container and cap, especially when the container holds a liquid under pressure such as a carbonated beverage.

SUMMARY OF THE INVENTION

This invention aims at providing a cap able to withstand the pressure of a carbonated beverage.

For this purpose, the recessed top wall of the pan bottom of the cap is connected to its lateral cylindrical wall by a part in the shape of a crown, of a pair of truncated conical sections delimiting, at the periphery of the bottom wall, an annular groove of approximately triangular section projecting, in relation to the recessed top wall, from the same side as the free end of the outside skirt.

As a result of the presence of this crown part of a V or triangular crosswise section, when a pressure is exerted against the recessed top wall of the cap from inside the container and tends to lift the cap, because of its V section, the crown part which surrounds the recessed top wall transmits to the lateral cylindrical wall of the cap a radial force directed outward which tends to flatten it against the inside face of the wall of the container neck. Thus, the pressure which prevails inside the container tends to increase the locking of the cap onto the neck of the container.

According to an embodiment of this cap perfectly suitable for obtaining this result, the angle at the top of the most central truncated part of the crown is between 105° and 155° and preferably is equal to 130° C., and the angle at the top of the outermost truncated part of the crown is between 35° and 85° and, preferably, is equal to 60°, the value of these angles at the top being linked to the inside diameter of the neck, i.e. to the outside diameter of the cylindrical lateral wall of the recessed top of the cap.

According to another embodiment of the present invention, the inside threading of the outside skirt of this cap is a cylindrical threading and advantageously comprises two threads.

DESCRIPTION OF THE DRAWINGS

In any case, the invention will be better understood with the help of the following description, with reference to the accompanying diagrammatic drawing representing, by way of nonlimiting example, an embodiment of this cap.

DETAILED DESCRIPTION OF THE DRAWINGS

Figure 1:
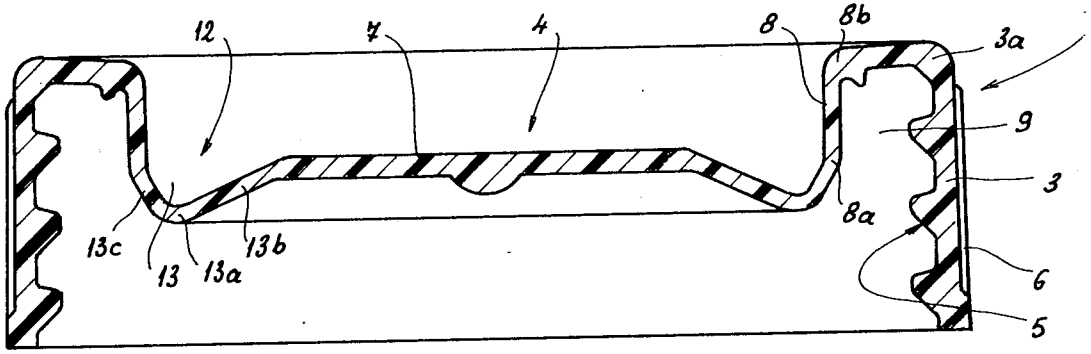
FIG. 1 is a view in axial section.

As FIG. 1 shows, tight screw cap 2 for a threaded container neck of the invention is of the type exhibiting a cylindrical outside skirt 3 and a pan bottom 4. Outside skirt 3 exhibits, on its inside face, a threading 5 and, on its outside face, grooves 6 facilitating its maneuvering by the user.

Pan bottom 4 comprises a recessed top wall 7 itself of circular shape, surrounded by a lateral cylindrical wall 8 shorter than the outside skirt 3, integral at its lower edge **8*a* with recessed top wall 7 and connected, by its upper edge 8*b*, to upper edge 3*a* of outside skirt 3**.

Figure 2:
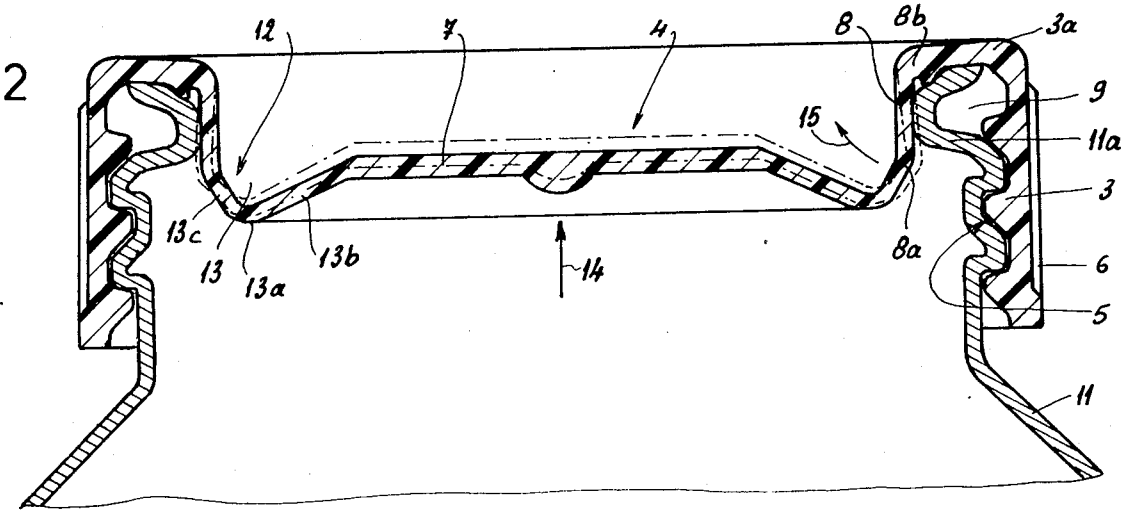
FIG. 2 is a view showing, in axial section, the threaded upper end of a container neck equipped with this cap and containing a carbonated beverage.

Between outside skirt 3 and the lateral cylindrical wall 8 of pan bottom 4 is an annular space 9 which houses the threaded upper end **11*a* of neck 11 of the container when the cap 2 is screwed on it, as illustrated in FIG. 2. The outside diameter of the lateral cylindrical wall 8 therefore is approximately equal to the inside diameter of the threaded upper end 11*a* of the neck 11** of the container.

This cap 2, which is made of injection molded plastic such as polyethylene, is intended to be used to close containers of blown injected plastic such as PVC or the like.

The object of the invention is to make this cap perfectly tight, even when the container holds a liquid under pressure such as a carbonated beverage, by generating on the inside of the container a pressure sufficient to cause the ejection of the cap.

According to the invention, the recessed top wall 7 of the cap 2 is connected to the lower edge **8*a* of the lateral cylindrical wall 8 by a part 12 in the shape of a crown formed by the meeting in a V-shape of two truncated cones delimiting, on the periphery of the recessed top wall 7, an annular groove 13 of approximately triangular section and whose circular edge 13*a* projects in relation to recessed top wall 7, on the same side as the free edge of outside skirt 3**.

As a result of this configuration of the pan bottom 4, pressure which may be developed on the inside of the container tends to lock the cylindrical wall 8 of pan bottom 4 against the inside face of the threaded upper end **11*a* of the neck 11 of the container as shown in phantom in FIG. 2**.

Thus, as shown in dotted lines in FIG. 2, such a pressure, by acting in the direction of arrow 14 on the bottom of the recessed top wall 7 of pan 4, tends to lift the recessed top wall and consequently to move it axially in relation to the outside skirt 3. This move therefore causes a modification of the angles at the top of the two truncated conical walls **13*b* and 13*e* of annular groove 13 and, particularly, a pivoting in the direction of arrow 15 of the outside truncated conical wall 13*c* of groove 13, which has the effect of expanding the radius of lower end 8*a* of cylindrical wall 8 and consequently of pressing it against the inside face of upper end 11*a* of neck 11 of the container, which thereby is squeezed between the outside skirt 3 and the lateral cylindrical wall 8** with increasing force as the pressure that prevails inside of the container increases.

Of course, provided the breaking limit of the material used in not exceeded, there is thus obtained an increase of the locking of cap 2 on threaded upper end 11*a* of neck 11 of the container as the pressure that prevails inside the container increases.

In the example illustrated in the drawing, in which the inside diameter of the neck is 25 millimeters, the angle at the top of the most central frustoconical wall 13*b* of groove 13 is equal to 130°, while the angle at the top of the outermost frustoconical wall 13*c* of groove 13 is equal to 60°. These values were adopted because they optimize the desired result.

To increase still more the holding of the cap on threaded upper end 11*a* of neck 11 of the container, it is advantageous for threading 5 along the inside face of outside skirt 3 to have a double thread, which obviously implies that the corresponding threading of threaded upper end 11*a* of neck 11 of the container is also provided with a double-thread threading.

Finally, it can be noted that this cap 2 can, like other types of caps, can be equipped, if desired, with a tearable tamperproof band.

The foregoing description of the specific embodiments will so fully reveal the general nature of the invention that others can, by applying current knowledge, readily modify and/or adapt for various applications such specific embodiments without departing from the generic concept, and therefore such adaptations and modifications are intended to be comprehended within the meaning and range of equivalents of the disclosed embodiments. It is to be understood that the phraseology or terminology employed herein is for the purpose of description and not of limitation.

What is claimed is:

1. A one-piece cap for a threaded container neck comprising:

a cylindrical outside skirt having an inside face and an outside face and an upper edge and a lower edge, said outside skirt having threading on its inside face;

a circular recessed top wall surrounded by a lateral cylindrical wall connected to and integral with an upper edge of said outside skirt, the outside diameter of said lateral cylindrical wall corresponding to the inside diameter of the threaded upper end of the container neck, the length of the lateral cylindrical wall being less than that of the cylindrical outside skirt;

said recessed top wall being connected to said lateral cylindrical wall by inner and outer truncated conical walls delimiting at the periphery of the recessed top wall an annular groove of approximately triangular section;

said triangular section projecting, in relation to the bottom wall, in the same direction as the lower edge of the outside skirt.

2. The cap according to claim 1 wherein the angle at the top of said inner truncated conical wall is from about 105 to about 155 degrees, and the angle at the top of said outer truncated conical wall is from about 35 to about 85 degrees.

3. The cap according to claim 2 wherein the inside threading of the outside skirt is a cylindrical threading.

4. The cap according to claim 3 wherein the inside cylindrical threading of the outside skirt has a double thread.

5. The cap according to claim 1 wherein the inside threading of the outside skirt is a cylindrical threading.

6. The cap according to claim 5 wherein the inside cylindrical threading of the outside skirt has a double thread.

7. A one-piece cap according to claim 1 wherein said outside skirt has grooves on its outside face.

8. A one-piece cap according to claim 1 wherein said lateral cylindrical wall, corresponding to the inside diameter of the threaded upper end of the container neck, has a substantially uniform wall thickness.

* * * * *